US005388621A

United States Patent [19]

Warren et al.

[11] Patent Number: 5,388,621

[45] Date of Patent: Feb. 14, 1995

[54] PRESSURIZED TRANSFER TANK SECURITY SYSTEM

[75] Inventors: Jerome Warren, Mandeville, La.; Randall Wilson, Dewey, Okla.

[73] Assignee: ICEE Ventures, Inc., Metairie, La.

[21] Appl. No.: 131,589

[22] Filed: Oct. 5, 1993

[51] Int. Cl.[6] ..... B65D 49/00

[52] U.S. Cl. ..... 141/21; 141/3; 141/18; 141/67; 141/285; 141/326; 222/147; 137/513.7

[58] Field of Search ..... 141/2, 3, 5, 18, 21, 141/67, 285, 286, 302, 307, 325, 326; 222/147; 215/14, 17, 18, 21, 26; 137/239, 513.7

[56] References Cited

U.S. PATENT DOCUMENTS

| | | | |
|---|---|---|---|
| 1,788,358 | 1/1931 | Goerg | 137/513.7 X |
| 1,908,031 | 5/1933 | Rue et al. . | |
| 2,501,611 | 3/1950 | Nicholson | 141/3 |
| 3,339,811 | 9/1967 | Haag | 222/394 |
| 4,323,173 | 4/1982 | Shannon | 137/513.7 X |
| 4,523,687 | 6/1985 | Hullihen | 215/25 |
| 4,741,368 | 5/1988 | Crumby | 141/18 |
| 4,941,519 | 7/1990 | Sestak et al. | 141/22 |
| 4,947,739 | 8/1990 | Owen | 141/18 X |
| 4,949,878 | 2/1990 | Jacobi | 222/382 |
| 5,031,802 | 7/1991 | Joulia | 222/205 |

FOREIGN PATENT DOCUMENTS

| | | | |
|---|---|---|---|
| 0146877 | 8/1936 | Australia | 141/18 |
| 2598687 | 11/1987 | France . | |
| 643759 | 8/1962 | Italy . | |

*Primary Examiner*—J. Casimer Jacyna

[57] ABSTRACT

The present invention relates to a transfer tank security system for liquids such as beverage syrups which discourages the unauthorized filling of the transfer tank through either the pressurized gas inlet and/or the liquid outlet. This is accomplished by providing a flow restrictor in line with the pressurized gas inlet and/or the liquid outlet, which flow restrictor severely limits the rate at which a liquid can be introduced into the transfer tank through either the pressurized gas inlet and/or the liquid outlet.

11 Claims, 2 Drawing Sheets

PRESSURIZED TRANSFER TANK SECURITY SYSTEM

BACKGROUND OF THE INVENTION

1. Field of the Invention

The present invention relates to a container which discourages unauthorized filling of transfer tanks through either the gas pressurization connection or the liquid discharge connection.

2. Description of Related Art

Unauthorized filling of beverage syrup transfer tanks is a continuing problem in the industry. The problem is two-fold. (1) When a syrup beverage tank is filled in an environment other than an authorized syrup plant, the normal sanitizing procedure is by-passed and the probability is high that contamination will be introduced into the tank, and (2) the legal owner of the beverage tank receives no income from the syrup that someone else puts into the tank.

As shown in FIG. 1, normal filling of a transfer tank is accomplished by removing an elliptical lid 1 and pouring syrup through an opening in the top of the tank. Normal transfer of liquid from the transfer tank 2 is accomplished by pressurizing the tank with gas via a gas inlet tubing 3 to the external gas connector 4 and into the transfer tank through the gas inlet tube 5. As pressure builds up in the transfer tank 2, liquid is forced up the liquid interior tube 6 through the external liquid discharge connector 7 and into the liquid discharge tubing 8. Elliptical lid 1 is held in place by pressure within the transfer tank and a lead wire type seal is installed so that removal of the elliptical lid 1 requires destruction of the seal. In addition, the fittings 9 on the transfer tank 2 that the external liquid discharge connector 7 and the external gas connector 4 attach to, have lead wire seals installed so that the removal of these fittings would require the breaking of the seals.

SUMMARY OF THE INVENTION

It is an object of the present invention to provide a pressurized transfer tank security system which discourages the unauthorized filling of the transfer tank through the liquid discharge connection and/or the gas pressurization connection.

This is accomplished by providing a check valve in line with the liquid discharge connection which allows a liquid such as beverage syrup to be passed outwardly through the check valve for discharge of the syrup from the container but which severely restricts the flow of liquid in a reverse direction through the check valve and back into the container. This is important when an attempt is made to pour or pump liquid back into the container from the liquid outlet through the check valve assembly in the reverse direction. Due to a limited amount of liquid being able to flow in the reverse direction, the check valve and discharge connector can easily be cleaned.

In one embodiment, the present invention is directed to a transfer tank system for use in transferring liquids by gas pressure, comprising a transfer tank having a storage area, a pressurized gas inlet connectable to a source of pressurized gas, a liquid outlet, an interior tube having an upper end operably connected with the liquid outlet and a lower end located in the storage area of the transfer tank, and a check valve assembly located in the interior tube, the check valve assembly containing a primary orifice, a secondary orifice which has a cross-sectional area which is at most one-quarter, preferably at most one-sixth, more preferably at most one-eighth and most preferably at most one-tenth the cross-sectional area of the primary orifice, and a sealing member which seals the primary orifice when a liquid is forced into the upper end of said interior tube but which fails to seal said secondary orifice when a liquid is forced into the upper end of the interior tube.

In another embodiment, the transfer tank security system for use in transferring syrup for soft drinks by gas pressure comprises a transfer tank having a storage area, a top and a bottom, a pressurized gas inlet connectable to a source of pressurized gas, a liquid outlet located in the transfer tank top, an interior tube having an upper end operably connected with the liquid outlet and a lower end located in said storage area near the bottom of the transfer tank, a check valve assembly located in the interior tube comprising a liquid impermeable first flow restrictor which contains a primary orifice and a secondary orifice having a cross-sectional area which is at most one-quarter, preferably at most one-sixth, more preferably at most one-eighth and most preferably at most one-tenth the cross-sectional area of the primary orifice and a sphere which has a density greater than the density of syrup for soft drinks, wherein the primary orifice is positioned in the first flow restrictor so that the sphere can seal the primary orifice and the secondary orifice is positioned in the liquid impermeable flow restrictor so that the sphere cannot seal the secondary orifice, and a second flow restrictor in line with the pressurized gas inlet having an orifice which has a cross-sectional area which is at most one-quarter, preferably at most one-sixth, more preferably at most one-eighth and most preferably at most one-tenth the cross-sectional area of the primary orifice in the first flow restrictor.

In yet another embodiment, the present invention is directed to a transfer tank security system for use in transferring liquids by gas pressure, comprising a transfer tank having a storage area, a pressurized gas inlet connectable to a source of pressurized gas, the pressurized gas inlet having a pressurized gas inlet orifice, a liquid outlet, an interior tube having an upper end operably connected with the liquid outlet and a lower end located in the storage area of the transfer tank and a liquid discharge orifice located in line with the interior tube and the liquid outlet, wherein the pressurized gas inlet orifice has a cross-sectional area which is at most one-quarter the cross-sectional area of the liquid discharge orifice.

The present invention is also directed to a method for storing and transferring liquids comprising the steps of providing a transfer tank with a storage area and a liquid outlet, filling a liquid into the storage area, introducing a gas into the storage area, the gas pressurizing an interior of the storage area, providing an interior tube in the storage area, the interior tube being connected to the liquid outlet, providing an insert in the interior tube, the insert having a primary orifice and a secondary orifice, and discharging liquid from the storage area through at least the primary orifice in the interior tube and out of the liquid outlet, wherein the primary orifice is sealed when liquid is forced into the liquid outlet while the secondary orifice remains open and wherein liquid is charged into the storage area only through the secondary orifice when the liquid is forced into the liquid outlet, the sealing of the primary orifice preventing liquid from entering the storage area through the primary orifice.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
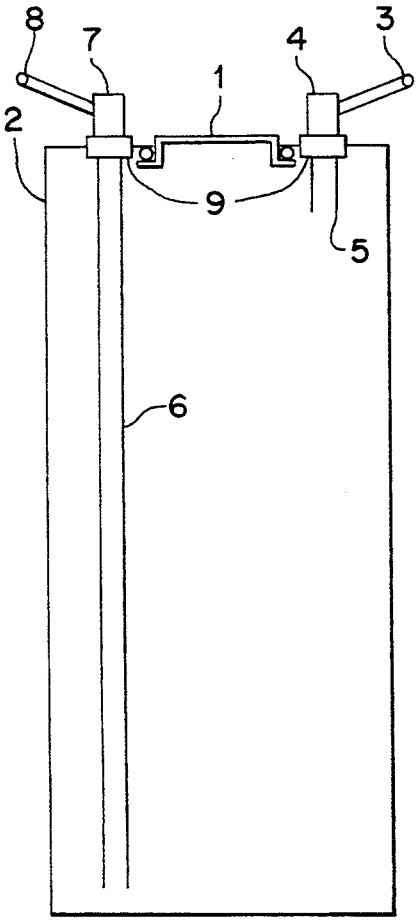
FIG. 1 is a cross-sectional side view of a conventional beverage syrup transfer tank.
Figure 2:
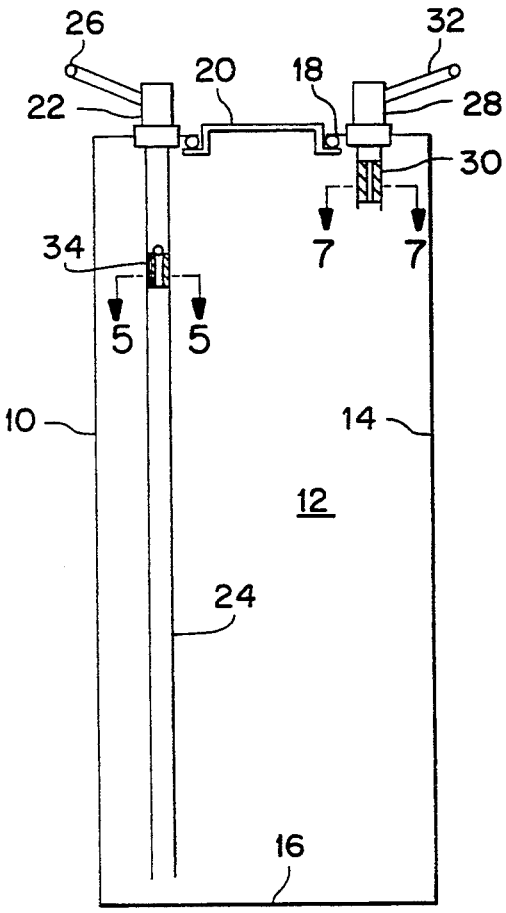
FIG. 2 is a cross-sectional side view of the transfer tank of the present invention.
Figure 3:
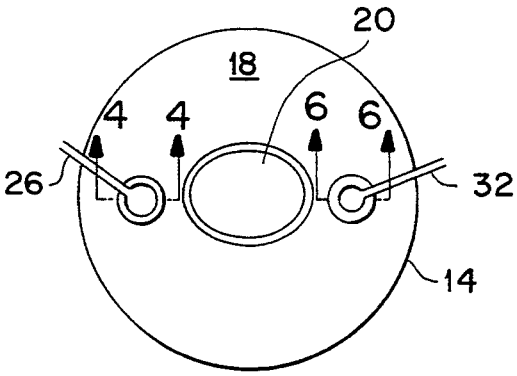
FIG. 3 is a top view of the tank of FIG. 2.

As shown in FIGS. 2–7, the transfer tank security system of the present invention comprises a transfer tank 10 having a storage area 12. The tank has a generally cylindrical sidewall 14, a flat generally disc-shaped bottom wall 16 and a top 18. The transfer tank can be formed from any suitable material. One particularly useful material is food grade stainless steel.

On the top of the tank 10, an elliptical lid 20 is provided. The lid is held in place by pressure inside the tank. This elliptical lid is removable and allows easy filling of the transfer tank. The lid is constructed in a conventional manner. The transfer tank also includes a liquid discharge connector 22 which is mounted on the top 18 of the transfer tank. The liquid discharge connector 22 will open and close to permit and prevent discharge of liquid from the tank 10. The liquid discharge connector 22 is connected at its lower end with a interior tube 24 and at its upper end with liquid discharge tubing 26. The transfer tank also includes an external gas connector 28 which is mounted in the top 18 of the transfer tank. The external gas connector connects a gas inlet tube 30, which is located inside the transfer tank, with an external gas inlet tubing 32 which is located outside of the transfer tank.

Figure 5:
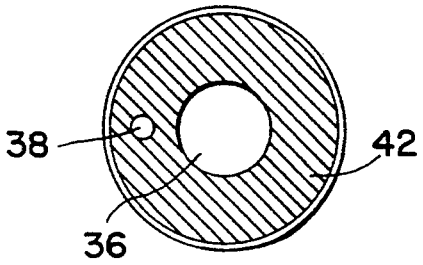
FIG. 5 is a detailed cross-sectional view of the check valve assembly taken along line 5—5 of FIG. 2.
Figure 4:
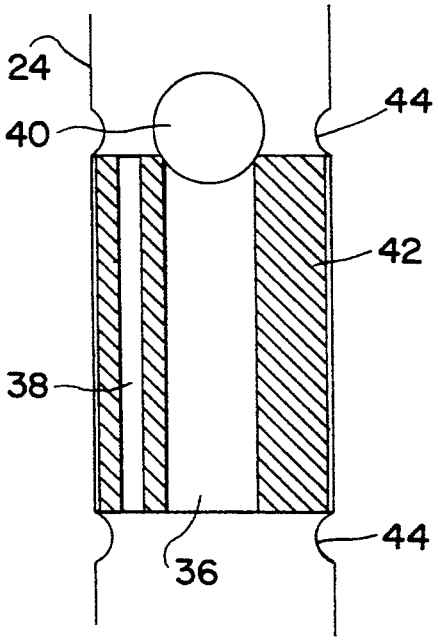
FIG. 4 is a detailed cross-sectional view of the check valve assembly taken along line 4—4 of FIG. 3.

Referring now to FIGS. 4 and 5, a check valve assembly 34 is provided in the interior tube 24. The purpose of the check valve assembly is to allow liquid to pass upwardly (outwardly) through the check valve assembly at a rate which is high enough to allow efficient removal of syrup from the transfer tank during normal use, but which only allows liquid to pass very slowly downwardly (inwardly) through the check valve assembly so that unauthorized filling of the transfer tank 10 through the liquid discharge tubing 26 is impractical. In a preferred embodiment, this is accomplished by providing in the check valve assembly a primary liquid discharge orifice 36, a secondary orifice 38 which has a cross-sectional area which is significantly smaller than the cross-sectional area of the primary orifice, i.e., about one-fourteenth of the cross-sectional area of the primary orifice, and a sealing member such as a stainless steel ball 40 which seals the primary orifice 36 when a liquid is forced into the upper end of the interior tube but which does not seal the secondary orifice when a liquid is forced into the upper end of the interior tube. The primary and secondary orifices are formed in an insert 42 which can be held in place in the interior tube 24 by any suitable means such as by forming rolling grooves 44 above and below the insert in the interior tube which physically hold the insert 42 in place. The primary orifice 36 has a diameter of d and the secondary orifice 38 has a diameter of $\frac{1}{4}$ d, for example.

The interior tube 24, the plastic insert 42 (made of food grade DELRIN TM (DuPont)) and the stainless steel ball 40 can be made of any suitable materials. The materials should be inert in and stable to the beverage syrups or other liquids which are held in the transfer tank and should be formed from a material which can be easily cleaned when a cleaning solution is passed into the transfer tank security system. The secondary orifice 38 should be large enough to allow cleaning solution to pass therethrough when forced into or poured into the liquid discharge connector 22. The sealing member 40 is preferably formed from stainless steel since stainless steel has a specific gravity which is greater than the specific gravity of the syrup and therefore the stainless steel ball will easily sit on and seal the upper end of the primary orifice 36. However, any other material which has a specific gravity greater than the syrup can be used. Although in the preferred embodiment of the present invention the stainless steel ball merely sits on the upper end of the primary orifice 36, any sealing member can be used and such a sealing member can be held in this position by a spring (not shown) or other means which allows the sealing member to become unseated during withdrawal of syrup from the transfer tank. Moreover, a seat can be provided around the upper end of primary orifice 36 for receiving the ball 40 or other sealing member.

Figure 7:
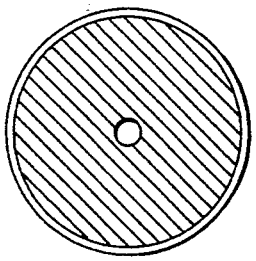
FIG. 7 is a detailed cross-sectional view of the plastic insert taken along line 7—7 of FIG. 2.
Figure 6:
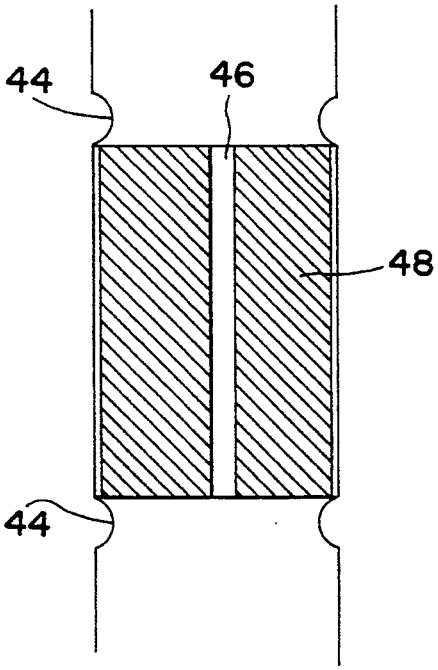
FIG. 6 is a detailed cross-sectional view of the gas inlet tube taken along line 6—6 of FIG. 3.

Turning now to FIGS. 6 and 7, these Figures show the details of a flow restrictor which has a small orifice 46 therein. The orifice is sized so that sufficient gas can pass through the orifice in order to pressurize the transfer tank in a reasonable amount of time during normal operation, but if a filling of the tank through this orifice is attempted, it will take a very long time to fill the tank thereby discouraging unauthorized filling of the tank with liquid. The orifice 46 has a cross-sectional area which is at most one-quarter, preferably at most one-sixth, more preferably at most one-eighth and most preferably at most one-tenth the cross-sectional area of the primary orifice in the first flow restrictor. The flow restrictor is formed from food grade DELRIN TM (DuPont) plastic insert 48 containing an orifice 46 having a diameter of about one-thirtieth (1/30) of an inch, for example, drilled lengthwise through the cylinder. The orifices 46 and 38 preferably both have the same diameter.

In normal operation, a supply of liquid, such as beverage syrup, is filled in tank 10 through the opening which is then sealed with lid 20. Then, pressurized gas is introduced into the transfer tank security system through the tubing 32. The pressurized gas passes through the external gas connector 28 and the orifice 46 into the transfer tank 10. As the gas pressure builds up, the syrup or other liquid in the tank 10 is forced into the lower end of the interior tube 24 and upwardly through the check valve assembly 34 when the liquid discharge connector 22 is opened. As the syrup passes through the primary orifice 36, the stainless steel ball 40 is unseated from the upper end of the primary orifice 36 and the syrup passes around the stainless steel ball 40, through the liquid discharge connector 22 and out of the liquid discharge tubing 26. The stainless steel ball 40 is sufficiently small so that when the syrup passes around the ball 40, there is sufficient space for the syrup to easily pass between the ball and the sides of the interior tube 24 without undue pressure build up. Also, the ball 40 and location of secondary orifice 38 are designed such that this ball 40 will not close the secondary orifice 38.

If an unauthorized attempt is made to fill the transfer tank through the liquid discharge connectors 22 and vent any pressure build up through the gas connector 28, the stainless steel ball 40 is forced down onto the plastic insert 42 thereby sealing the primary orifice 36, allowing liquid to pass only through the smaller secondary orifice 38. Filling of the transfer tank with liquid through this smaller orifice 38 will require a very long period of time making it impractical. The smaller secondary orifice 38 is necessary so that a cleaning solution can be circulated through the interior tube 24 during sanitizing of the transfer tank.

In discussing the relative cross-sectional areas of the "orifices", the "orifice" will usually be the narrowest or flow limiting region which is in line with either the liquid outlet or the pressurized gas inlet.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A transfer tank security system for use in transferring liquids by gas pressure, comprising:

a transfer tank having a storage area, the transfer tank having first, second and third openings to the interior thereof, the first, second and third openings being the only openings to the interior of the transfer tank;

a pressurized gas inlet connectable to a source of pressurized gas, the pressurized gas inlet being the first opening to the interior of the transfer tank;

a liquid outlet, the liquid outlet being the second opening to the interior of the transfer tank;

an interior tube having an upper end operably connected with said liquid outlet and a lower end located in said storage area of said transfer tank;

a lid provided on the transfer tank, the lid closing the third opening to the interior of the transfer tank, liquids being charged into the interior of the transfer tank through the third opening when the lid is open and the lid sealing the third opening during discharge of liquid from the tank; and a check valve assembly located in said interior tube, said check valve assembly containing a primary orifice, a secondary orifice which has a cross-sectional area which is at most one-quarter a cross-sectional area of said primary orifice and a sealing member which seals said primary orifice when a liquid is forced into the upper end of said interior tube, said secondary orifice being open when the liquid is forced into the upper end of said interior tube and when the primary orifice is sealed by the sealing member.

2. The transfer tank security system of claim 1, wherein said check valve assembly comprises a liquid impermeable flow restrictor which contains said primary and secondary orifices, and wherein said primary orifice and said secondary orifice are positioned in said liquid impermeable flow restrictor, said sealing member sealing only said primary orifice so that said sealing member fails to seal said secondary orifice.

3. The transfer tank security system of claim 2, wherein said secondary orifice is eccentrically located within said interior tube.

4. The transfer tank security system of claim 1, wherein said secondary orifice has a cross-sectional area which is at most one-eighth the cross-sectional area of said primary orifice.

5. The transfer tank security system of claim 1, wherein said check valve assembly comprises a generally cylindrical insert having the primary orifice which passes generally through a center of said insert, said primary orifice having a generally circular upper sealing surface, the secondary orifice being located in the insert, an upper end of said secondary orifice being located between said first bore and said interior tube, and the sealing member comprises a sphere located above said insert, the sphere sealing said primary bore when liquid is forced in the upper end of said interior tube and both the primary orifice and secondary orifice having longitudinal axes which are generally parallel to one another, the primary orifice and secondary orifice having substantially the same length.

6. A method for storing and transferring liquids, comprising the steps of:

introducing a liquid into the storage area of the transfer tank of claim 1;

sealing the storage area of said transfer tank;

introducing pressurized gas into the storage area of said transfer tank through said pressurized gas inlet; and discharging said liquid from said transfer tank by passing said liquid through said interior tube and then through said liquid outlet.

7. A transfer tank security system for use in transferring syrup for soft drinks by gas pressure, the syrup having a predetermined density and the transfer tank security system comprising:

a transfer tank having a storage area, a top and a bottom, first, second and third openings being provided to the storage area, the first, second and third openings being the only openings to the storage area;

a pressurized gas inlet connectable to a source of pressurized gas, the gas inlet being the first opening to the storage area;

a liquid outlet located in the top of said transfer tank, the liquid outlet being the second opening to the storage area;

an interior tube having an upper end operably connected with said liquid outlet and a lower end located in said storage area near said bottom of said transfer tank;

a check valve assembly located in said interior tube comprising a liquid impermeable first flow restrictor, a primary orifice and a secondary orifice being defined in the first flow restrictor, the secondary orifice having a cross-sectional area which is at most one-quarter a cross-sectional area of said primary orifice, the primary orifice and the secondary orifice both having longitudinal axes which are generally parallel to one another, the check valve assembly further comprising a sphere which has a density greater than the density of the syrup for soft drinks, said primary orifice being positioned in said first flow restrictor so that said sphere can seal said primary orifice and said secondary orifice being positioned in said liquid impermeable flow restrictor so that said secondary orifice is out of contact with the sphere, the sphere only sealing the primary orifice and failing to seal said secondary orifice;

a second flow restrictor in said pressurized gas inlet, the second flow restrictor having an orifice with a cross-sectional area which is at most one-quarter the cross-sectional area of said primary orifice, the second flow restrictor being an insert which is fixedly mounted in the pressurized gas inlet and the orifice of the second flow restrictor extending an entire length of the insert; and a lid provided on the transfer tank, the lid closing the third opening to the storage area, syrup being charged into the storage area through the third opening when the lid is open and the lid sealing the third opening during discharge of syrup from the storage area.

8. The transfer tank security system of claim 7, wherein said secondary orifice has a cross-sectional area which is at most one-eighth the cross-sectional area of said primary orifice.

9. A method for storing and transferring syrup for soft drinks, comprising the steps of:

introducing the syrup into the storage area of the transfer tank of claim 7;

sealing the storage area of said transfer tank;

introducing pressurized gas into the storage area of said transfer tank through said pressurized gas inlet; and discharging said syrup from said transfer tank by passing said syrup through said interior tube and then through said liquid outlet.

10. A transfer tank security system for use in transferring liquids by gas pressure, comprising:

a transfer tank having a storage area;

a pressurized gas inlet connectable to a source of pressurized gas, said pressurized gas inlet having a pressurized gas inlet orifice;

a liquid outlet;

an interior tube having an upper end operably connected with said liquid outlet and a lower end located in said storage area of said transfer tank; and a check valve assembly located in line with said interior tube, said check valve assembly comprising a liquid discharge orifice located in line with said interior tube and said liquid outlet, a secondary orifice which has a sectional area of which is at most one-quarter a cross-sectional area of said liquid discharge orifice and a sealing member which seals said liquid discharge orifice when a liquid is forced into the upper end of said interior tube, said secondary orifice being open when the liquid is forced into the upper end of said interior tube and when the liquid discharge orifice is sealed by the sealing member, and said pressurized gas inlet orifice having a cross-sectional area which is at most one-quarter the cross-sectional area of said liquid discharge orifice.

11. The transfer tank security system of claim 10, wherein said pressurized gas inlet orifice has a cross-sectional area which is at most one-eighth the cross-sectional area of said liquid discharge orifice.

* * * * *